US006923236B2

(12) United States Patent
Lin

(10) Patent No.: US 6,923,236 B2
(45) Date of Patent: Aug. 2, 2005

(54) SECTOR CURTAIN

(76) Inventor: Tzong-Fu Lin, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/645,717

(22) Filed: Aug. 18, 2003

(65) Prior Publication Data

US 2005/0039862 A1 Feb. 24, 2005

(51) Int. Cl.[7] ..... A47H 5/00

(52) U.S. Cl. ..... 160/84.01; 160/84.04; 160/134; 160/330

(58) Field of Search ..... 160/84.01, 84.03, 160/84.04, 84.07, 134, 243, 173 R, 330, 340, 115, 385

(56) References Cited

U.S. PATENT DOCUMENTS 1,326,249 A * 12/1919 Batty ..... 160/84.01
4,739,815 A * 4/1988 Altman ..... 160/84.01
4,877,075 A * 10/1989 Markowitz ..... 160/84.01
4,909,297 A * 3/1990 Koller et al. ..... 160/84.01
4,928,743 A * 5/1990 Wojtysiak ..... 160/84.01
5,207,257 A * 5/1993 Rupel et al. ..... 160/84.07
5,341,864 A * 8/1994 Rupel et al. ..... 160/84.03
5,662,147 A * 9/1997 Haiber ..... 139/384 R
6,431,245 B1 * 8/2002 Shen ..... 160/84.03
6,543,516 B2 * 4/2003 Hwang ..... 160/84.01
6,591,887 B1 * 7/2003 Hsu ..... 160/84.03
6,679,309 B2 * 1/2004 Hsu ..... 160/84.01
2004/0159408 A1 * 8/2004 Smith et al. ..... 160/84.01

* cited by examiner

*Primary Examiner*—Bruce A. Lev

(57) ABSTRACT

A curtain assembly contains a long cloth. An upper extending portion has a plurality of parallel and equally spaced first folding portions, a plurality of first supporting portions, and a plurality of first rings. The first folding portions are seamed to be as a bag. The second folding portions are seamed to be formed with left and right bags for receiving the second supporting portions. A flexible cloth sleeve is placed between each two bags. A plurality of second rings are seamed to be between the left and right bags. A stopper is combined to the top portion and is controlled by a rope unit so as to stop the cloth at a predetermined position. When second ends of the control ropes of the rope unit move upwards, the second rings of the lower extending portions will overlap so as to form a sector area.

3 Claims, 10 Drawing Sheets

SECTOR CURTAIN

FIELD OF THE INVENTION

The present invention relates to sector curtains, and particularly to a sector curtain having at least one lower extending portions which can present various section shapes so as to have beautiful outlook.

BACKGROUND OF THE INVENTION

There are several kinds of curtains are used, such as cloth curtains, venetian shades, etc. Curtains are necessary for shielding a window so as to protect the privacy of those inside the door. Moreover, the curtains can provide a beautiful outlook to the window, even the building having the window. In general, the folding and releasing of curtains are controlled by ropes. In the prior art curtains, the curtains presents a dull outlook. In general, the curtains presents as a rectangular shape, which are not attractive to viewers. Thereby, there is an eager demand for a novel design which can improve this prior art defects so as to present a beautiful outlook.

SUMMARY OF THE INVENTION

Accordingly, the primary object of the present invention is to provide a sector curtain having a curtain assembly contains a long cloth. An upper extending portion has a plurality of parallel and equally spaced first folding portions, a plurality of first supporting portions, and a plurality of parallel and equally spaced first rings. The first folding portions are seamed to be as a bag. The second folding portions are seamed to be formed with a plurality of left bags and a plurality of right bags for receiving the second supporting portions. A flexible cloth sleeve is placed between a left bag and a respective right bags. A plurality of second rings are seamed to be between the left and right bags so as to fix the second rings to be on the flexible cloth sleeve; the plurality of first ring and second rings are at the same axial line. A stopper is combined to the top portion and is controlled by a rope unit so as to stop the cloth at a predetermined position. When second ends of the control ropes of the rope unit move upwards, the second rings of the lower extending portions will overlap so as to form a sector area.

The various objects and advantages of the present invention will be more readily understood from the following detailed description when read in conjunction with the appended drawing.

DETAILED DESCRIPTION OF THE PREFERRED EMBODIMENTS

Figure 1:
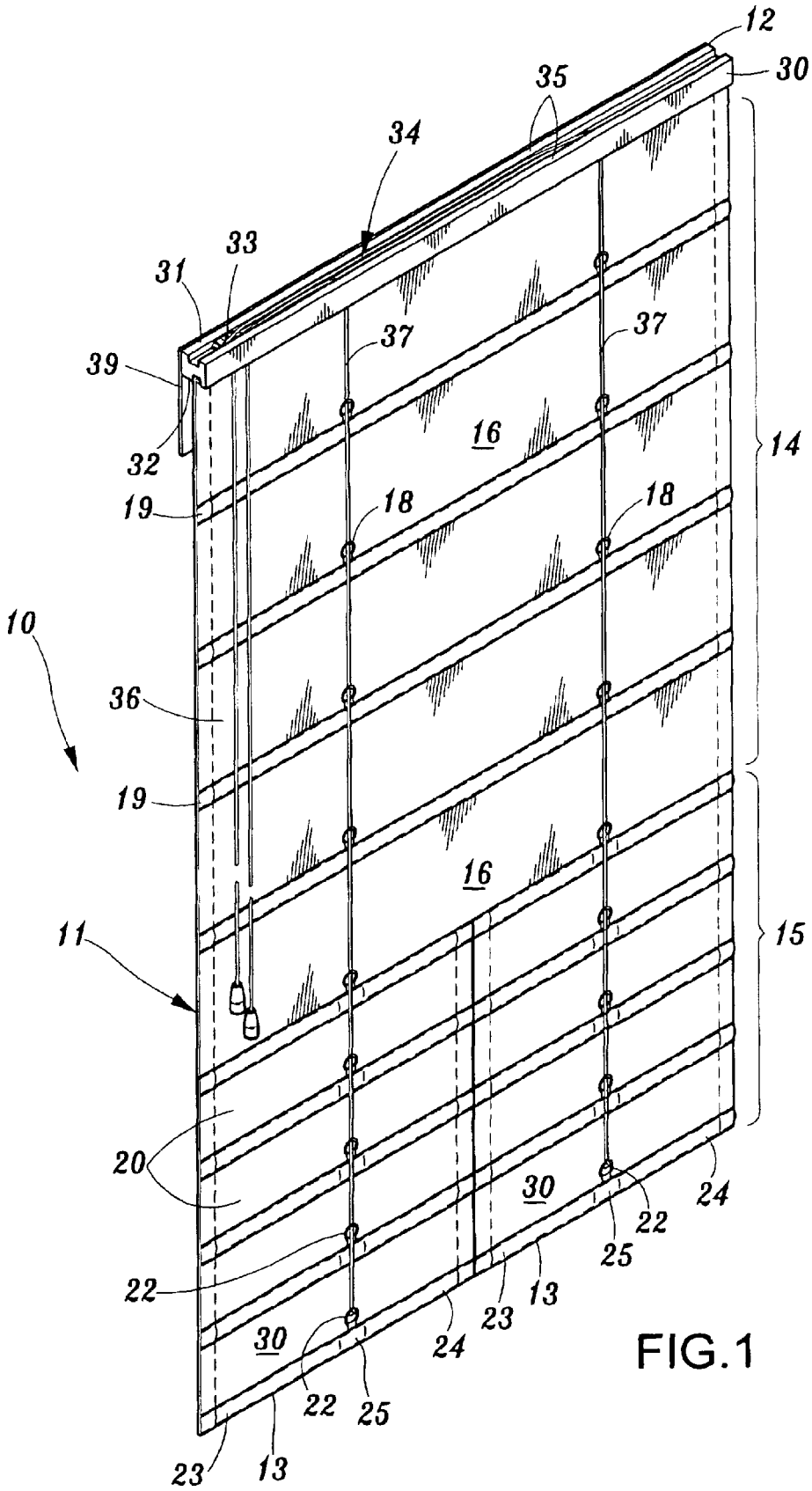
FIG. 1 is a perspective view showing the full extension of the cloth of the sector curtain of the present invention.
Figure 2:
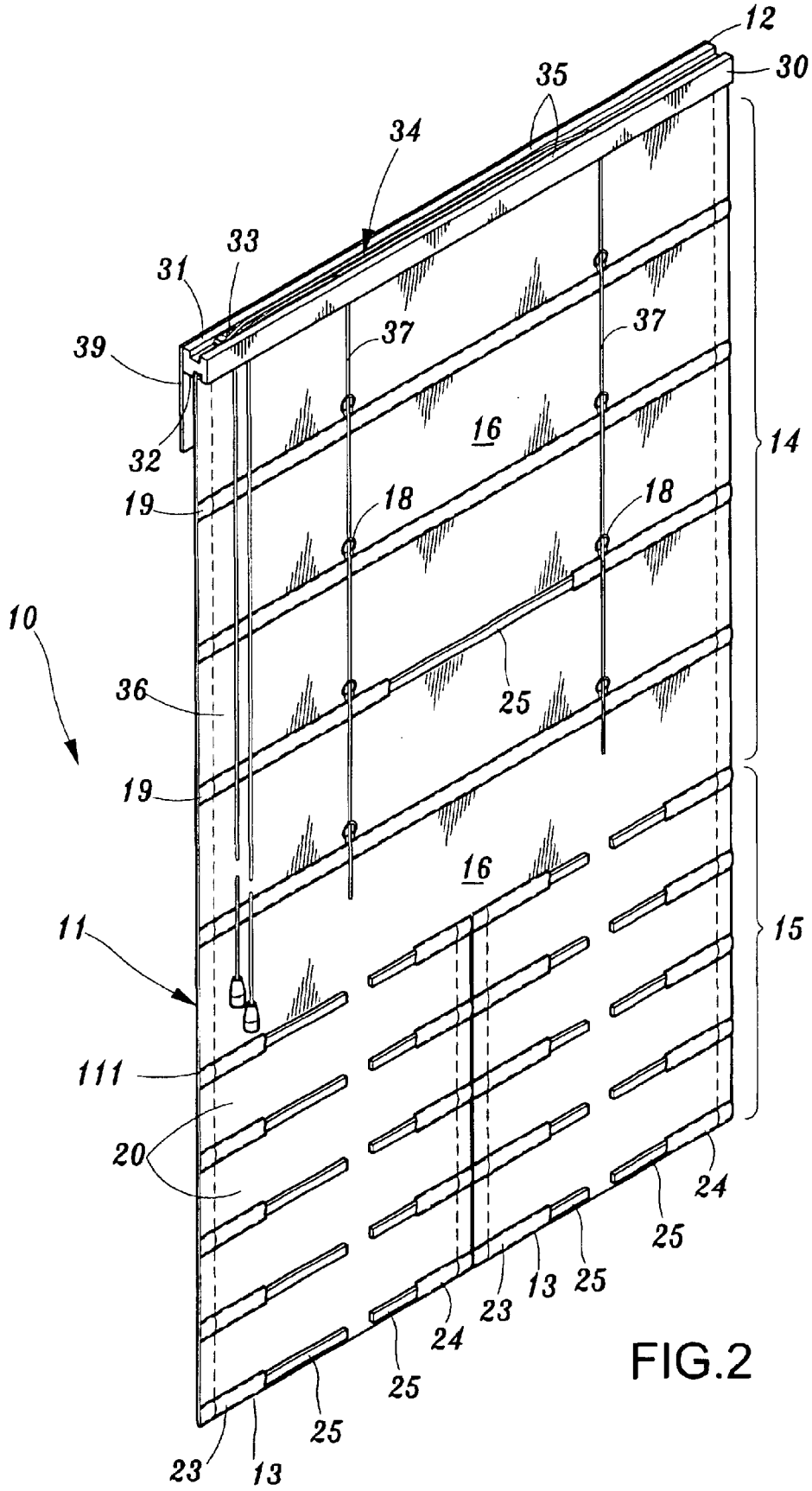
FIG. 2 is a backside view of the cloth of the sector curtain according to the present invention, where the sector curtain is fully extended.

Referring to FIGS. 1 and 2, the sector curtain includes a curtain assembly 10 and an upper beam 30. The curtain assembly 10 includes a long cloth 11. The cloth 11 is made of opaque cloth and has a top end 12, a lower end 13, an upper extending portion 14 and a plurality of lower extending portions 15.

The upper extending portion 14 has a plurality of parallel and equally spaced first folding portions 16, a plurality of first supporting portions 17, and a plurality of parallel and equally spaced first rings 18. The connection of two adjacent first folding portions 16 is seamed with a connecting bag 19 so that each of the connecting bag receives with one of the plurality of first supporting portions. The first supporting portions 17 have sufficient stress to support the plurality of first folding portions 16 to be in an equilibrium state when it is raised up or descended.

The plurality of first rings 18 are seamed to be connected on the bag 19 so that the first rings 18 are arranged as two parallel banks on upper extending portion 14. The number of the first rings 18 are determined by the width and size of the cloth 11. Therefore for a wide cloth 11, the first rings 18 can be arranged as three banks.

At least one lower extending portions 15 is arranged on a lower end of the upper extending portion 14. In the present invention, two lower extending portions 15 are illustrated. Each of the lower extending portion includes a plurality of parallel and equal spaced second folding portions 20, a plurality of second supporting portions 21, and a plurality of parallel and equal spaced second rings 22. The second folding portions 20 are seamed to be formed with a plurality of left and a plurality of right bags 23 and 24, respectively, for receiving the second supporting portions 21. A flexible cloth sleeve 25 is placed between the two bags 23 and 25.

The plurality of second rings are seamed to be between the left and right bags 23 and 24 so as to fix the second rings 22 to be on the flexible cloth sleeve 25. The plurality of first ring and second rings are at the same axial line.

The upper beam 30 has a top portion 31 and a bottom portion 32. The bottom portion 32 is combined to a top 12 of the cloth 11. The top portion 31 is combined with a stopper 33. The stopper 33 is controlled by a rope unit 34 so as to stop the cloth 11 at a predetermined position. In this embodiment, the rope unit 34 is formed by two ropes 35. Each rope 35 has a first end 36 and a second end 37. The first ends of the two ropes 35 extend out by using the stopper 33 so that the user can pull it. The second ends 37 of the two ropes 37 protrudes into one bank of the first rings 18 and second banks 22. Moreover, the second ends 37 of the ropes are firmly secured to the second rings 22 at the lower side of the cloth 11.

Figure 3:
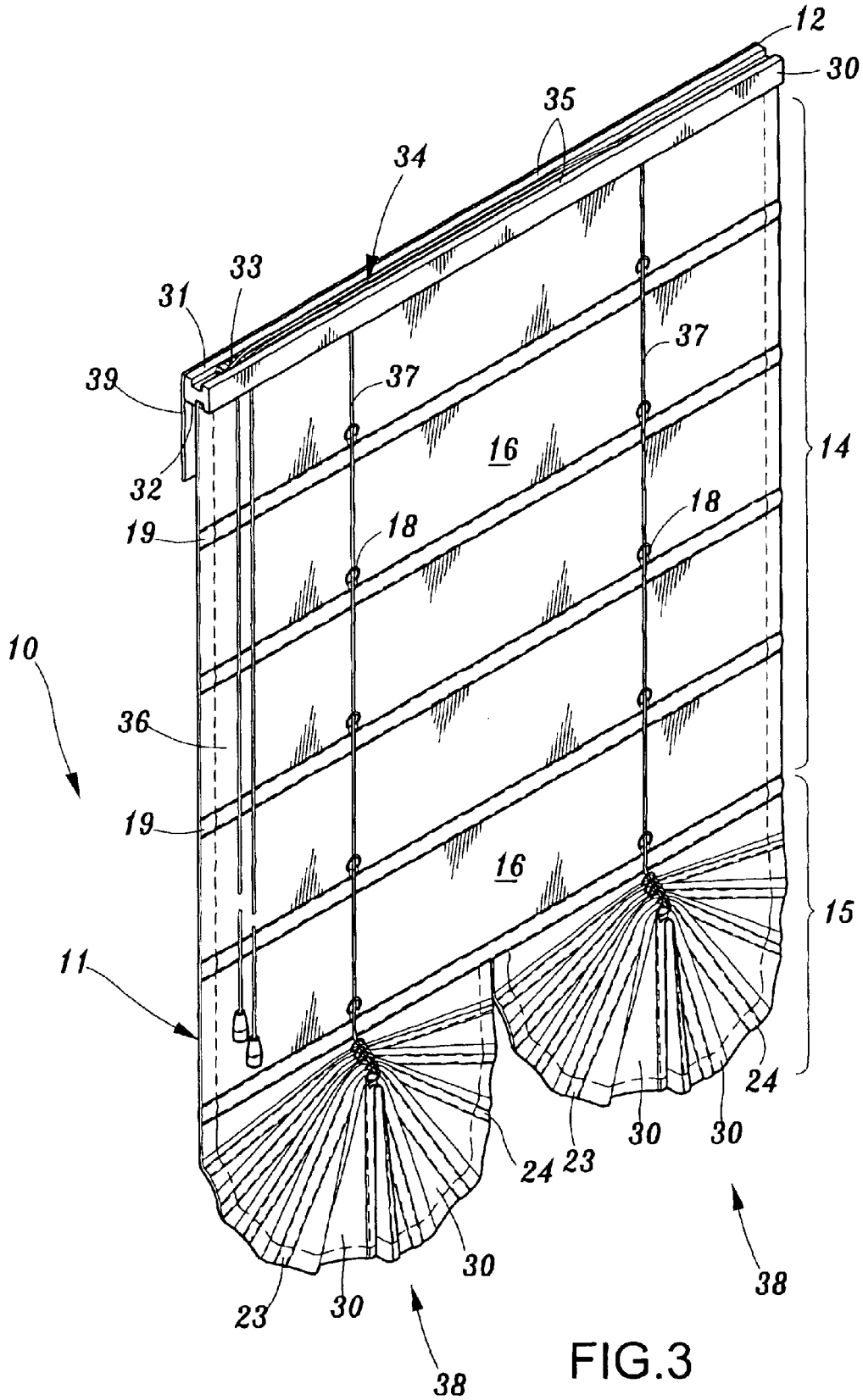
FIG. 3 is a backside view of the cloth of the sector curtain according to the present invention, where the lower extending portions are folded.
Figure 4:
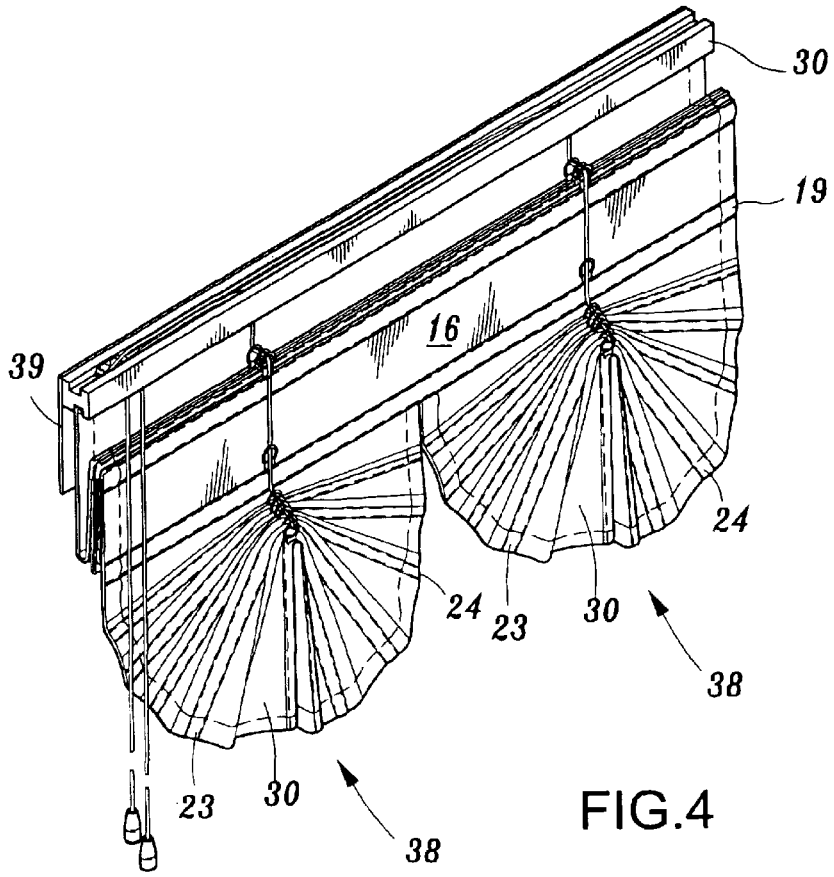
FIG. 4 is a rear perspective view showing the folding of the cloth of the sector curtain according to the present invention.

When the sector curtain is installed to a window frame, the first folding portions 16 and the second folding portions 20 are controlled by the rope unit 32 so that the lower end 13 of the cloth 11 can be opened, as shown in FIG. 1. When the first ends 36 of the ropes 35 are pulled downwards to a predetermined distance, the second ends 37 of the ropes 35 move upwards synchronously to overlap the second rings 22 on the lower extending portions 15. The second folding portions 20 have a flexible cloth 25. By the weight of the second supporting portions 21, the second folding portions 20 will cause that the left and right bags 23, 24 to move closer so that the lower extending portions 15 are formed as two beautiful sector area 38, as shown in FIG. 3. If the first ends of the ropes 35 are pulled downwards, the sector area 38 moves upwards with the upper extending portion 14. At the same time, the second rings 18 of the upper extending portion 14 are overlapped with the upward pulling of the second ends 37 so that the first supporting portions 17 are folded and overlapped completely, as shown in FIG. 4. The movement positions of the FIGS. 3 and 4 cause that the lower extending portions 15 of the sector curtain 10 has two section forms.

Figure 5:
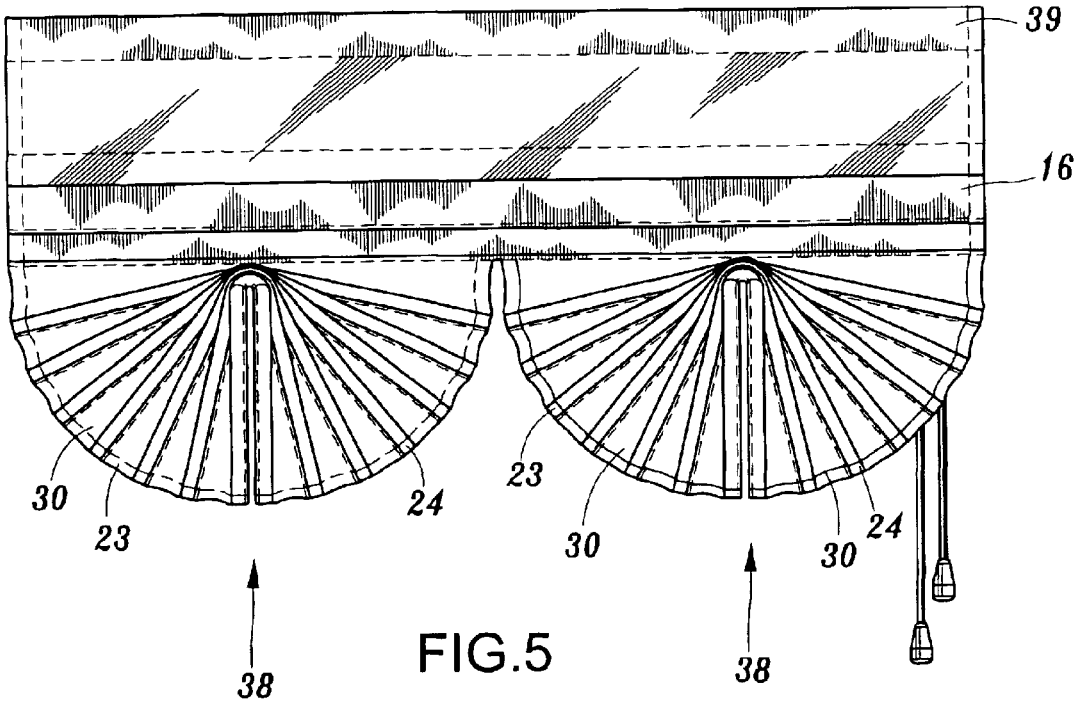
FIG. 5 is a front perspective view showing the folding of the cloth of the sector curtain according to the present invention.

A decorating sheet 39 has a means to be combined with the surface of the upper beam 30 for shielding the combination of the cloth 11 and upper beam 30 so as to present a beautiful outlook, as shown in FIG. 5.

Figure 6:
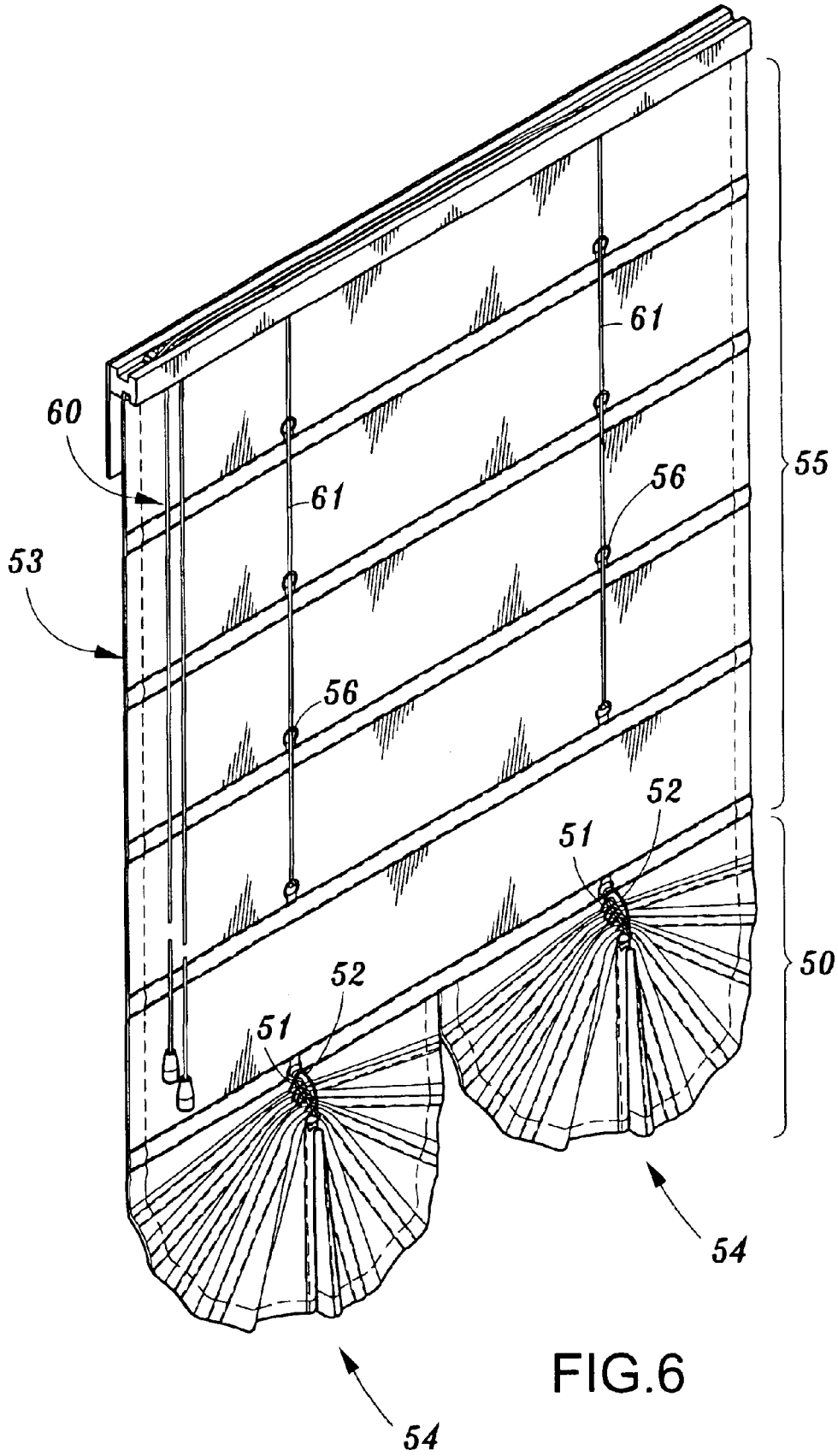
FIGS. 6 and 7 show another embodiment of the present invention, where the upper extending portion is fully extended (FIG. 6) and is folded (FIG. 7).
Figure 7:
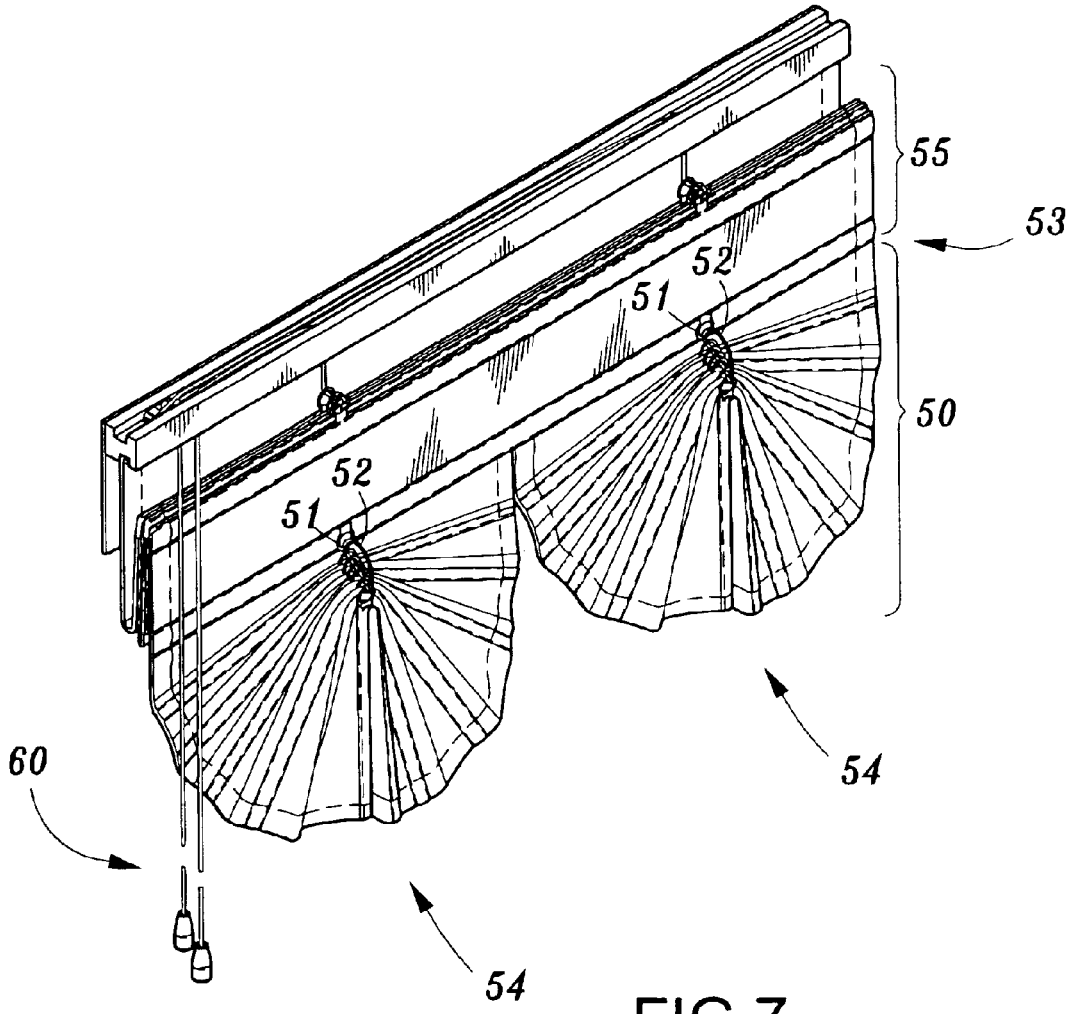

With reference to FIGS. 6 and 7, in the plurality of second rings 51 of the lower extending portions 50, a wire 52 is used to overlap the plurality of second rings 51. Therefore, the lower extending portions 15 of the cloth 53 are formed as a sector area 54, as shown in FIG. 6. The second end 61 of the rope 60 passes through the second rings 56 of the upper extending portions 55. Thereby, the upper extending portions 55 of the cloth 53 are controlled by the second ends of the ropes 60 so as to be folded upwards or extend downwards. The movement of the upper extending portions 55 will drive the sector area 54, as shown in FIG. 7.

Figure 8:
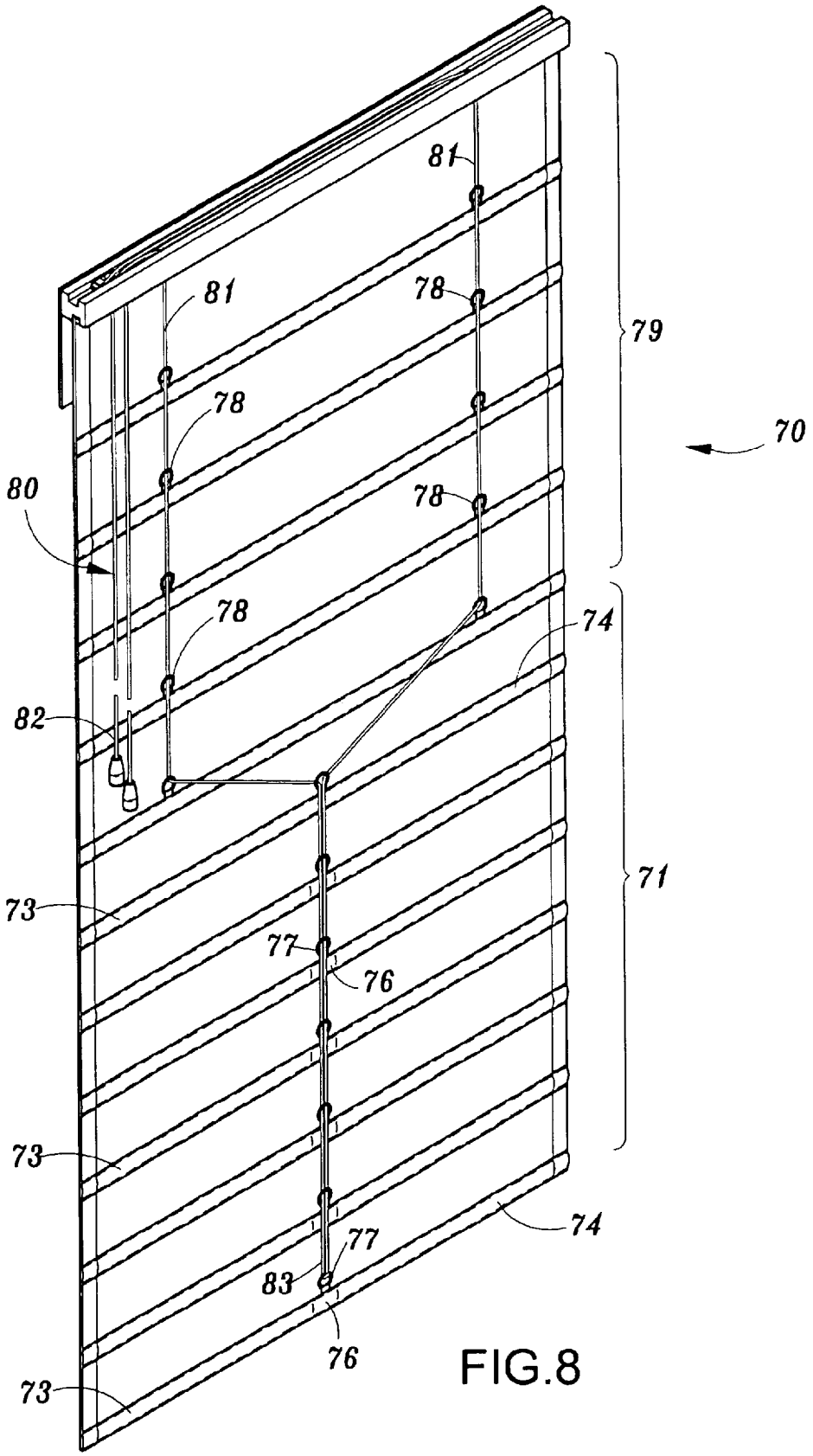
FIGS. 8 and 9 shows another embodiment of the sector curtain of the present invention, wherein a back view and a partial back side cross section view showing that the cloth fully extends.
Figure 9:
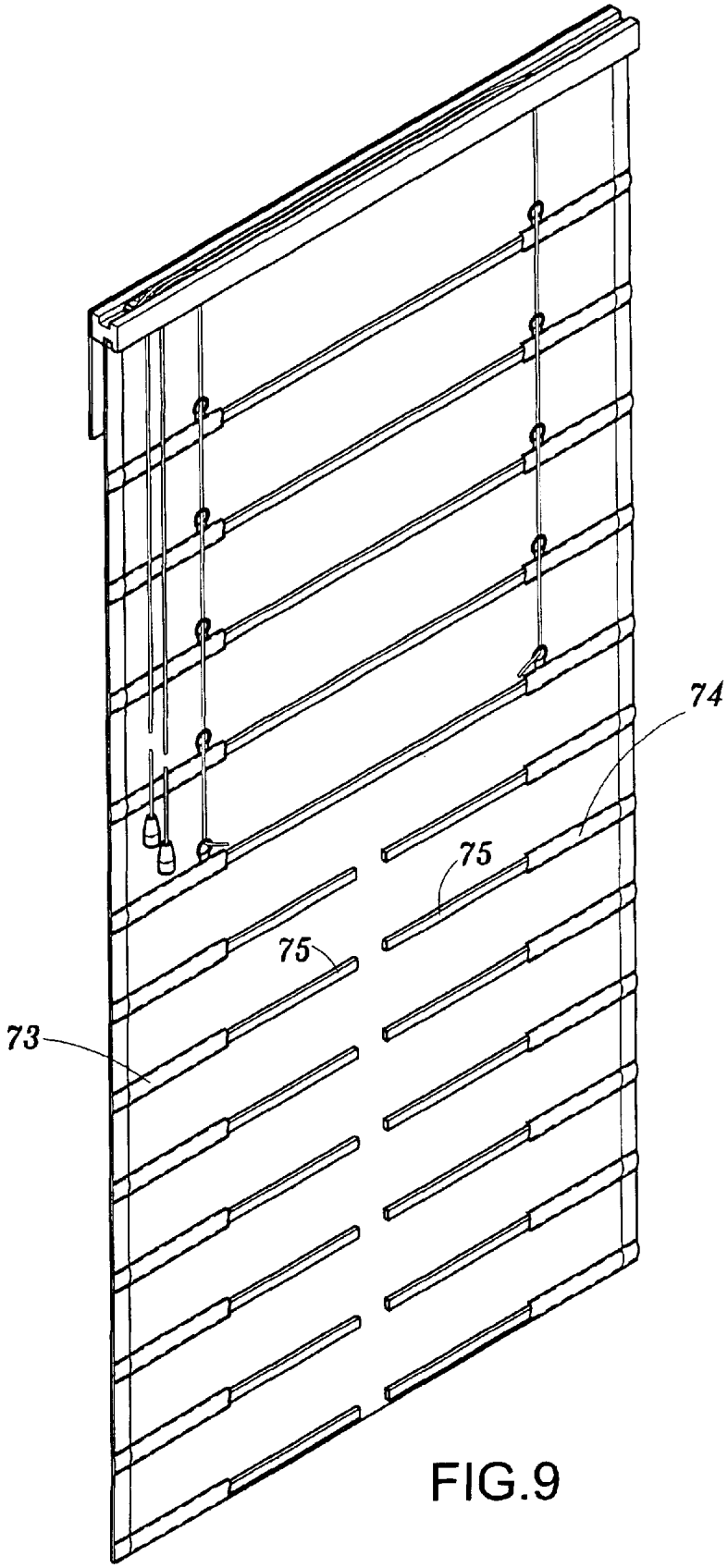

FIGS. 8 and 9 show another embodiment about the lower extending portion 71 of the cloth 70. When the lower extending portion 71 is pulled by the rope 80, the lower extending portion 71 extends with a sector shape. The lower extending portion 71 is connected to the upper extending portion 79. The lower extending portion 71 includes a plurality of parallel second folding portions 72. Each of the second folding portion 72 has a left bag 73 and a right bag 74 which are not connected to one another. Each of the left bag 73 and right bag 74 is received with a respective second supporter 75 connected the left bag 73 and the right bag 74. A flexible cloth sleeve 76 is installed between a pair of left bag 73 and right bag 74 and receives the second supporter 75 protruded from the respective right bag 74 or left bag 73.

Each of a plurality of second rings 77 is seamed between a respect pair of left bag 73 and right bag 74 of the second folding portion 72 and are fixed to the flexible cloth sleeve 76 of the second folding portion 72.

The two control ropes 81 of the rope unit 80 are passed through two banks of the first rings 78 of the upper extending portion 79 and then are combined to pass through the second rings 77 of the lower extending portion 71.

Figure 10:
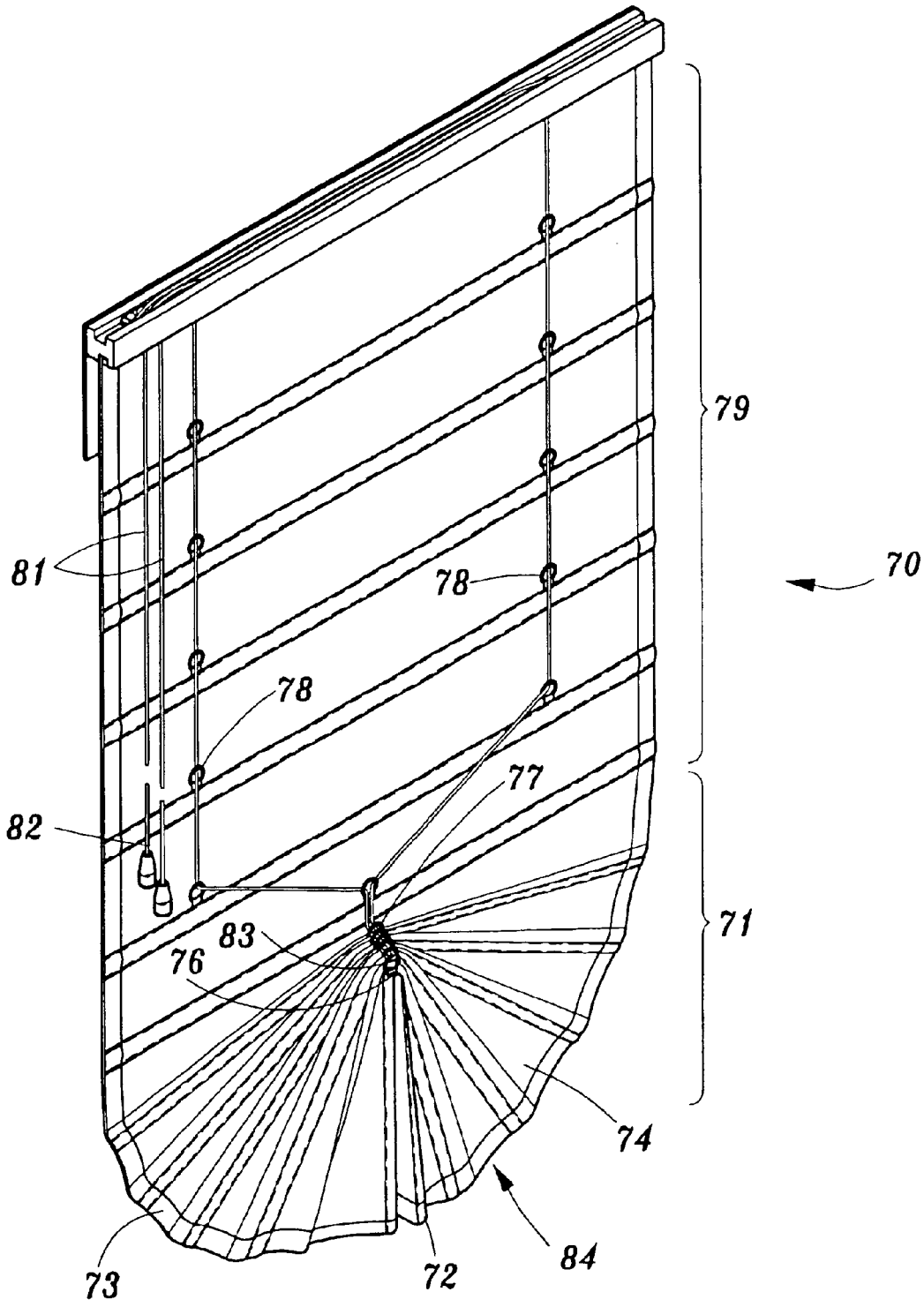
FIG. 10 shows a back side perspective view of the sector curtain of the present invention, wherein the lower extending portion is extended downwards so as to present a sector shape.
Figure 11:
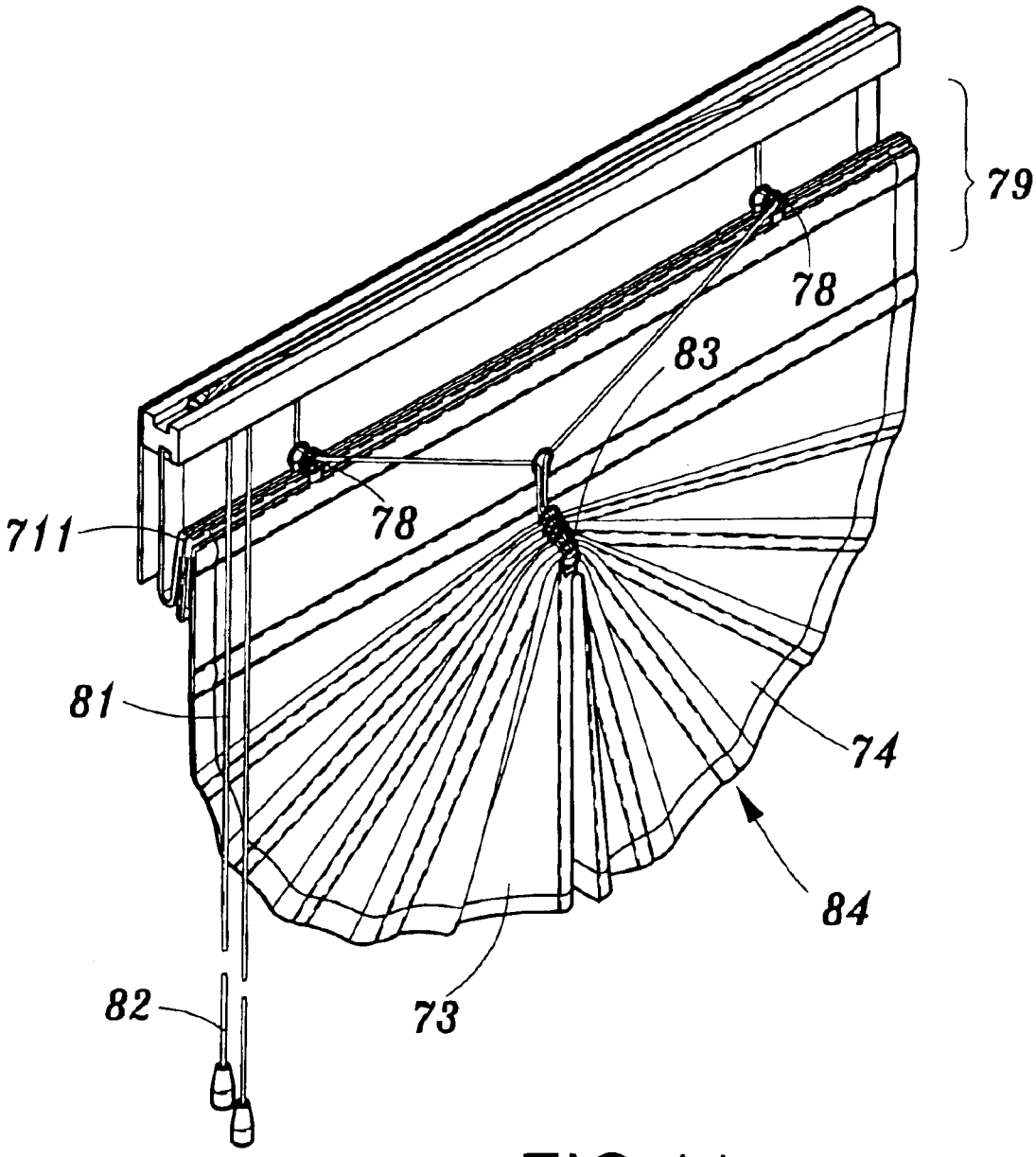
FIG. 11 is a front perspective view showing that the sector curtain of FIG. 10 is folded.

When the first ends of the control ropes 81 are pulled downwards to a predetermined length, the second ends of 83 of the control ropes 81 moves upwards so that the first rings 77 of the lower extending portion 71 are overlapped. Since the second folding portion 72 has a plurality of flexible cloth sleeves 76, the left bag 73 moves towards right bag 74 by the weights of the second supporter 75 so that the lower extending portion 71 is formed with a sector shape 84, as shown in FIG. 10. If the first ends of the control ropes 81 are pulled downwards continuously, the sector 84 will move with the upper extending portion 79. If now the second ends 83 of the control ropes 81 are pulled upwards, the plurality of first rings 78 of the upper extending portion 79 will overlap with one another so that the first folding portion 711 are folded and overlapped, as shown in FIG. 11.

Moreover, the lower extending portion 71 of the sector curtain of the present invention may be formed with a plurality of sector shapes so as to appear a beautiful outlook.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sector curtain comprising:

a curtain assembly having a long cloth; the cloth having a top end; a lower end, an upper extending portion and a plurality of lower extending portions;

the upper extending portion having a plurality of parallel and equally spaced first folding portions, a plurality of first supporting portions, and a plurality of first rings which are arranged as at least two banks; different banks of the first rings being arranged in parallel; connection of two adjacent first folding portions being seamed with a connecting bag; and each of the connecting bags receiving one of the plurality of first supporting portions; and the plurality of first rings being connected to the bag;

at least one lower extending portions being arranged on a lower end of the upper extending portion; each of the lower extending portion including a plurality of parallel and equal spaced second folding portions, a plurality of second supporting portions, and a plurality of second rings which are arranged as at least two banks, the different banks of the second rings are arranged in parallel; the number of the banks of the second rings being equal to that of the banks of first rings; the second folding portions being seamed to be formed with a plurality of left bags and a plurality of right bags; each of the left bags and left bags serves for receiving one of the plurality of second supporting portions; a flexible cloth sleeve being placed between the two bags; between one left bag and one adjacent right bag being mounted with a second ring so as to fix a plurality of second rings on the flexible cloth sleeve; a wire passing through the second rings so that the second rings are overlapped as a sector area;

an upper beam having a top portion and a bottom portion; the top of the upper beam having a stopper and the bottom portion being connected to the top end of the cloth;

a rope unit being formed by a plurality of ropes; each rope having a first end and a second end; the first ends of the ropes passing through the stopper and being controlled by the stopper so that the ropes is able to stop at a predetermined position; the second ends of the ropes passing through and being combined to the first rings; the first ends of the ropes will control the folding portions of the upper extending portion to be folded upwards or extended downwards.

2. The sector curtain as claimed in claim 1, wherein the upper beam is combined with a decorating piece so that the sector curtain has a beautiful outlook.

3. A sector curtain a curtain assembly having a long cloth; the cloth having a top end; a lower end, an upper extending portion and at least one lower extending portion;

the upper extending portion having a plurality of parallel and equally spaced first folding portions, a plurality of first supporting portions, and a plurality of first rings which are arranged as two banks; the two banks of the first rings being arranged in parallel; connection of two adjacent first folding portions being seamed with a connecting bag; and each of the connecting bags receiving one of the plurality of first supporting portions; and the plurality of first rings being connected to the bag;

each of the at least one lower extending portions being arranged on a lower end of the upper extending portion; each lower extending portion including a plurality of parallel second folding portions; each of the second folding portions having a left bag and a right bag which are not connected to one another; each of the left bag and right bag is received with a respective second supporter connected the left bag and the right bag; between a pair of left bag and respective right bag being installed with a flexible cloth sleeve;

each of a plurality of second rings being mounted between a respect pair of left bag and right bag of the second folding portion and being fixed to the flexible cloth sleeve of the second folding portion; the plurality of second rings which are arranged as one bank;

an upper beam having a top portion and a bottom portion; the bottom portion being combined to a top of the cloth; a stopper being combined to the top portion; and two control ropes being passed through two banks of the first rings of the upper extending portion and then being combined to pass through the bank of the second rings of the lower extending portion;

wherein when the first ends of the control ropes are pulled downwards to a predetermined length, the second ends of the control ropes moves upwards so that the first rings of the lower extending portion are overlapped; since the second folding portion has a plurality of flexible cloth sleeves, the left bag moves towards right bag by the weights of the second supporter so that the lower extending portion is formed with a sector shape.

* * * * *